United States Patent [19]

Bohlke et al.

[11] 3,987,384

[45] Oct. 19, 1976

[54] ARRANGEMENT FOR COUPLING AN ARMATURE TO THE CONTACT-BRIDGE CARRIER

[75] Inventors: Günter Bohlke; Siegfried Seidel, both of Amberg, Germany

[73] Assignee: Siemens Aktiengesellschaft, Munich, Germany

[22] Filed: Aug. 1, 1974

[21] Appl. No.: 493,897

[30] Foreign Application Priority Data

Aug. 6, 1973 Germany ..... 2339799

[52] U.S. Cl. ..... 335/105; 335/277

[51] Int. Cl.[2] ..... H01H 51/30

[58] Field of Search ..... 335/104, 105, 193, 194, 335/270, 271, 277

[56] References Cited

UNITED STATES PATENTS

| | | | |
|---|---|---|---|
| 2,434,096 | 1/1948 | Ayers et al. | 335/277 |
| 3,060,355 | 10/1962 | Kruzic | 335/277 |
| 3,243,546 | 3/1966 | Woods | 335/193 |

FOREIGN PATENTS OR APPLICATIONS

| | | | |
|---|---|---|---|
| 1,138,141 | 10/1962 | Germany | 335/277 |
| 1,244,919 | 7/1967 | Germany | 335/270 |

*Primary Examiner*—G. Harris

*Attorney, Agent, or Firm*—Kenyon & Kenyon Reilly Carr & Chapin

[57] ABSTRACT

An arrangement for coupling the armature and contact-bridge carrier for an electromagnetic switching device, such as a relay which comprises an elastic interlay interposed between the contact-bridge carrier and the armature of the relay. The interlay is shaped substantially like the frustum of a cone. The first surface or base of the cone contacts the contact-bridge carrier, while the second surface or cut-off side of the cone frustum, contacts the armature. This arrangement, minimizes the lateral shock-loading of the contact-bridge carrier when the relay is switched off so that resulting mechanical moments are kept relatively small. Further, the arrangement provides an increased level of damping.

6 Claims, 3 Drawing Figures

ARRANGEMENT FOR COUPLING AN ARMATURE TO THE CONTACT-BRIDGE CARRIER

BACKGROUND OF THE INVENTION

1. Field of the Invention

This invention pertains to coupling mechanisms between the armature and contact-bridge carrier of a relay, and, particularly, a coupling mechanism which is elastic and which reduces the mechanical forces generated in the switching operation.

2. Description of the Prior Art

Elastic coupling mechanisms between the armature and the contact-bridge carrier of relays are known per se. In the past, the particular concern for such elastic coupling elements has been to minimize the chatter effect encountered when the relay is switched to an "on" position. An elastic coupling arrangement which minimizes the chatter effect to a great extent is described in the German patent, DT-OS 2,142,464.

In addition to the chatter effect, it is also desirable to minimize the mechanical moments generated by the lateral shock-loading of the contact-bridge carrier at the turning-off or opening of the contacts of a relay. The previously described arrangement did not provide a way by which this problem could be minimized.

It is therefore a primary object of this invention to provide an elastic coupling device which substantially dampens the shock-loading of the contact-bridge carrier at switch-off.

It is a further object of this invention to improve the damping at switch-off, but without substantially influencing the switch-on characteristics of the device.

SUMMARY OF THE INVENTION

An arrangement for coupling the armature and contact-bridge carrier for an electromagnetic switching device, such as a relay, which comprises an elastic interlay interposed between the contact-bridge carrier and the armature of the relay. The interlay has a first surface which contacts the contact-bridge carrier and a second surface parallel to the first surface. The second surface is concentrically aligned with the first surface and has a smaller surface area than the first surface. The interlay is shaped substantially like the frustum of a cone. The first surface or base of the cone contacts the contact-bridge carrier, while the second surface or cut-off side of the cone frustum, contacts the armature. This arrangement, minimizes the lateral shock-loading of the contact-bridge carrier when the relay is switched-off so that resulting mechanical moments are kept relatively small. Further, the arrangement provides an increased level of damping.

It is important to note that the elastic interlay may have any desired base planes and intersecting planes. The essential thing is that there be a sure support at the contact-bridge carrier and the armature for the interlay as well as a relatively large inherent damping in the elastic material so as to minimize any of the lateral forces generated due to the cocking of the armature. Towards this end, it is desirable to minimize the lever arm through which the lateral forces due to a cocked armature may be exerted on the contact-bridge carrier. Thus it is advantageous that the cut-off side of the conical frustum bear against the armature.

Further, to improve the stiffness of the elastic interlay, it is advantageous that the conical frustum be hollowed out, thereby having the appearance of a plate, and a rigid plate positioned within the hollowed-out cone. The damping can be increased with this type of design simply by retaining the rigid plate by the rim of the interlay.

The interlay can be utilized in most switching devices without any particular adaptation of the contact-bridge carrier or the armature. This is so because the interlay is designed to cover the opening containing the main contact spring.

In order to obtain for a given switching time improved switch-off characteristics, it is further advantageous that the side of the cone frustum contacting the armature have a central wartlike protrusion.

Finally, in order to eliminate twisting of the elastic interlay during the opening of the contact-bridge carrier and to facilitate the removal of the interlay from its mold during the vulcanization process, the interlay is provided with an appendage which locates itself in an appropriate cut-out in the contact-bridge carrier.

BRIEF DESCRIPTION OF THE DRAWINGS

Reference is now made to the accompanying drawings for a better understanding of the nature and objects of the invention. The drawings illustrate the best mode presently contemplated for carrying out the objects of the invention and its principles, and are not to be construed as restrictions or limitations on its scope. In the drawings.

DESCRIPTION OF THE PREFERRED EMBODIMENTS

Figure 1:
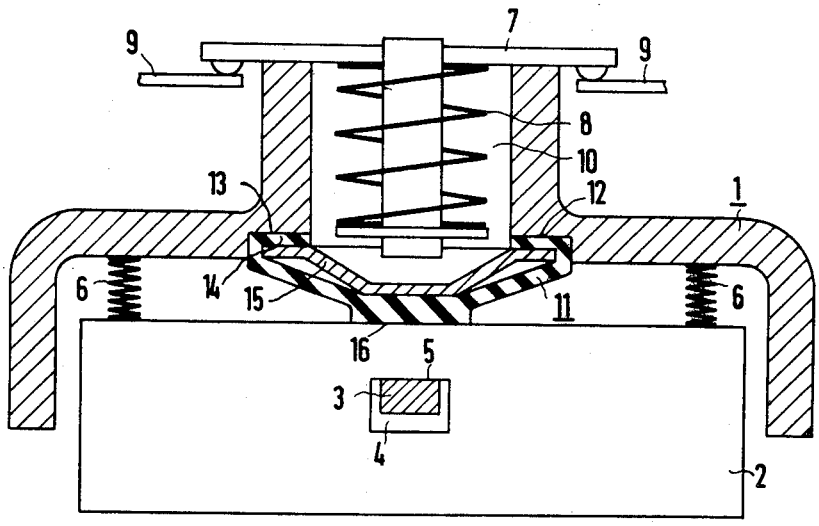
FIG. 1 is a schematic, cross-sectional view showing the interlay of the invention interposed between the contact-bridge carrier and the armature of a relay.

FIG. 1 depicts a typical contact-bridge carrier arrangement 1 and relay armature 2 which are positioned in a suitable housing, not shown, which allows sufficient clearance to enable the contact-bridge carrier 1 to be displaced in the same direction that the armature, 2, is displaced when the relay switches to a contact open position. The armature 2 is mechanically fastened to the contact-bridge carrier 1 by means of a bolt 3 which is inserted through an opening 4 and fastened to the carrier 1 in a known fashion. The bolts 3 bears against surface 5 of the opening 4. Springs 6 are interposed between the opposing surfaces of the contact-bridge carrier 1 and the armature 2. These springs exert a sufficient force between the two elements so that the armature is pressed against the surface 5.

The contact-bridge carrier arrangement, 1, includes a cylindrical opening 10 which is disposed substantially along the axis of the relay. Across one end of the opening 10 is a bridge 7 which spans the opening and makes contact between the fixed parts of the contact arrangement, 9. The contact springs 8 are held in the opening 10 in a known fashion, such that they cause the contact bridge 7 to bear positively against the fixed contact-parts 9.

Interposed between the armature 2 and the contact-bridge carrier 1 is an elastic interlay, 11. In the preferred embodiment of the invention, the interlay has the shape of a frustum of a cone. It includes a base edge portion 14 which seats itself on surface 12, which defines a recess 13. Recess 13 typically, would be annular in shape. The interlay 11, would be manufactured from a suitable material such as rubber and would have the necessary thickness to enable adequate switching-off and switching-on times.

In the preferred embodiment, the frustum shaped interlay has a plate-like shape with a plate-like disc 15 nested within the interlay. Edges 14 of the interlay serve to retain corresponding flanges on the plate-like disc 15 thus capturing the plate within the interlay.

The interlay 11 is positioned such that the base side of the cone nests in recess 13 and the cut-off side 16 bears against the corresponding surface of the armature. The diameter of the side bearing against the armature is considerably smaller than the outer diameter of the portion which contacts the seating surface 12. Because of the construction employed in the interlay, the diameter of the surface 16, which is the contacting surface of the cut-off side of the cone frustum, may be selected to minimize the lateral shock-loading forces to a predetermined maximum and yet enable the interlay to be utilized with the existing contact-bridge carrier and its corresponding opening 10.

Figure 2:
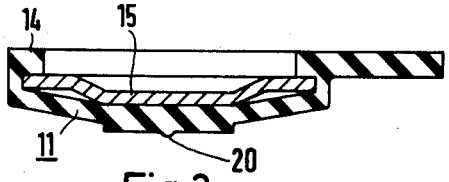
FIG. 2 is a elevation, sectional view of the interlay.
Figure 3:
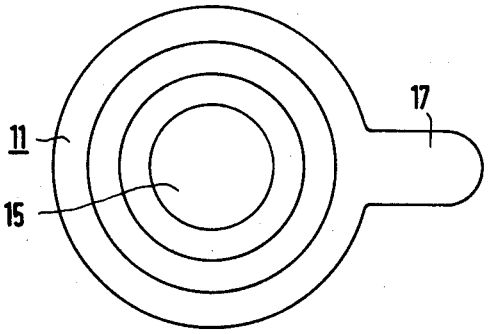
FIG. 3 is a plan view of the interlay of the invention.

As most readily seen in FIGS. 2 and 3, the interlay includes a radially extending appendage 17 which is positioned in a suitable recess in the contact-bridge carrier (not shown). This appendage 17 prevents displacement or turning of the plate-like disc 15 and the interlay 11 during the operation of the switching device.

In order to obtain maximum reduction of the lateral shock-loading effects, it is essential that the contacting surface 16 be as close as possible, centrally disposed relative to the armature. For the purpose of maintaining the surface 16 substantially along the longitudinal axis of the armature 2, a wartlike projection 20 is provided which retains the surface 16 in a fixed position on the contacting surface of the armature 2. This insures repeatability in the lateral shock-loading characteristic of the device and guarantees that the interlay provides a maximum effect in minimizing the shock-loads which contact-bridge carrier would experience without the interlay of this invention.

Other variations in the basic design described above are obvious to those skilled in the art and must be considered within the scope of the invention as defined in the appended claims.

What is claimed is:

1. An apparatus for coupling the armature and contact-bridge carrier of an electromagnetic switching device which comprises an elastic interlay having a first surface which contacts said contact-bridge carrier and a second surface parallel to said first surface, said second surface being concentrically aligned with said first surface and having a smaller surface area than said first surface, and said interlay being substantially in the form of a frustum of a cone which is hollowed out platewise, said frustum having a rigid plate laid therewithin.

2. The apparatus of claim 1 characterized in that said plate is embraced by the rim of said interlay.

3. The apparatus of claim 1 characterized in that said plate covers the opening for a main contact spring of said switching device.

4. In an apparatus for elastically coupling the armature and contact-bridge carrier of an electromagnetic switching device, said carrier including a longitudinal opening in which a contact spring is disposed, and said device including spring means interposed between said armature and said carrier for disposing said armature in engagement with a fixed planar surface of said carrier in a contact-closed position thereof, the improvement comprising a centrally-disposed, elastic interlay member interposed between said armature and carrier for damping movement of said carrier with respect to said armature during movement of said carrier to a contact-open position, said interlay member having a shape which is substantially in the form of a frustum of a cone and including a first surface which contacts said contact-bridge carrier and a second surface parallel to said first surface which contacts said armature, said second surface being concentrically aligned with said first surface and having a smaller surface area than said first surface.

5. The apparatus recited in claim 4, wherein said interlay member is hollowed out platewise and has a rigid plate laid therewithin which is embraced by the rim of said interlay member and covers said contact spring opening of said device.

6. The apparatus recited in claim 4, wherein said second surface of said conical frustum includes a wart-like protrusion extending axially outward thereform.

* * * * *